US007565869B2

(12) United States Patent
Daniel

(10) Patent No.: US 7,565,869 B2
(45) Date of Patent: Jul. 28, 2009

(54) UTILITY TABLE

(76) Inventor: Robert Daniel, 3884 Fredonia Dr., #D, Los Angeles, CA (US) 90068

( * ) Notice: Subject to any disclaimer, the term of this patent is extended or adjusted under 35 U.S.C. 154(b) by 532 days.

(21) Appl. No.: 11/160,538

(22) Filed: Jun. 28, 2005

(65) Prior Publication Data

US 2006/0288916 A1 Dec. 28, 2006

(51) Int. Cl.
*A47B 11/00* (2006.01)

(52) U.S. Cl. ..... 108/102; 108/92; 108/143

(58) Field of Classification Search ..... 108/92, 108/93, 59, 64, 176, 102, 143, 50.01, 50.02, 108/50.14
See application file for complete search history.

(56) References Cited

U.S. PATENT DOCUMENTS

| | | | | |
|---|---|---|---|---|
| 2,010,278 | A | 8/1935 | Snyder | |
| 2,213,828 | A | 9/1940 | Thomas | |
| 3,034,841 | A | 5/1962 | Blevins | |
| 3,602,160 | A | 8/1971 | Heal | |
| 4,083,597 | A | 4/1978 | Dowdy | |
| 4,646,655 | A | 3/1987 | Robolin | |
| 4,648,652 | A | 3/1987 | Van Kuren | |
| 4,700,987 | A | 10/1987 | Sraka et al. | |
| 4,852,500 | A | 8/1989 | Ryburg et al. | |
| 5,118,172 | A * | 6/1992 | Ugalde | 108/102 |
| 5,174,223 | A * | 12/1992 | Nagy et al. | 108/50.01 |
| 5,287,815 | A * | 2/1994 | Gross | 108/50.01 |
| 5,357,873 | A | 10/1994 | Hilton | |
| 5,419,525 | A | 5/1995 | Hilton | |
| 5,458,070 | A | 10/1995 | Gamba et al. | |
| 5,623,881 | A | 4/1997 | Huang | |
| 5,765,315 | A | 6/1998 | Nagamitsu et al. | |
| 5,842,425 | A * | 12/1998 | van der Aa | 108/64 |
| 6,003,452 | A | 12/1999 | Moore | |
| 6,161,487 | A | 12/2000 | Chang | |
| D438,401 | S * | 3/2001 | Lechman | D6/423 |
| 6,279,489 | B1 | 8/2001 | Daniel | |
| 6,824,230 | B2 * | 11/2004 | Probst | 108/50.01 |
| 6,935,247 | B2 * | 8/2005 | Schaefers et al. | 108/50.01 |

FOREIGN PATENT DOCUMENTS

| | | | | |
|---|---|---|---|---|
| FR | 2637475 | * | 4/1990 | 312/196 |
| JP | 03275005 A | * | 12/1991 | 108/93 |

* cited by examiner

*Primary Examiner*—Hanh V Tran
(74) *Attorney, Agent, or Firm*—Kelly Lowry & Kelley, LLP

(57) ABSTRACT

A table includes first and second table sides where each table side has a vertical plane. The table also includes upper and lower horizontal levels. There are at least two seating areas on the first table side, wherein an edge of the lower level at each seating area is substantially recessed from the first table side vertical plane, and at least two non-seating areas on the second table side, wherein the edge of the lower level at each non-seating area extends substantially to the second table side vertical plane. The lower level is movable to add a seating area to one of the first and second table sides and add a non-seating area to the other of the first and second table sides.

20 Claims, 7 Drawing Sheets

UTILITY TABLE

BACKGROUND OF THE INVENTION

The present invention is directed generally to a utility table. More particularly, the present invention is directed to a table which is configured so as to be useful for a variety of purposes.

In homes around the world, a common type of table found in front of couches and other casual seating is what is commonly referred to as a coffee table. A coffee table is typically about eighteen inches high. Such a height makes the coffee table ideal for use as a footrest, for holding books and magazines, and for holding a variety of other objects while not obscuring the view of people seated at the couch. However, this height makes the coffee table unsuitable for use when eating, reading, or working at the couch.

Most coffee tables are typically lower than the knees of a person seated at a couch, and this requires the seated person to both lean forward and crouch downward in order to use the coffee tabletop as an eating surface or a work surface. This position is extremely uncomfortable and can even lead to back pain and muscle aches over a period of time.

The size of individual chairs allows them to be moved with relatively ease, but the size and weight of sofas makes them generally stationary. A conventional arrangement, in combining seating and tables, is for the conventional table to be the heavier and generally immoveable object while a conventional chair is lighter and is the object that is moved. However, when a conventional table is used by two people sitting on a conventional sofa on one side of the table alone, at least part of the conventional table needs to be pushed away from the conventional sofa to enable one or other of two users to come or go from behind the table. This, of course, affects the other user by having the conventional table move away from him/her too, albeit it to a smaller degree, when the other user arrives or departs—an inconvenience, certainly, for those engaged in activities like dining. With conventional corner legs on the users' side of the conventional table, this would require substantial movement of the conventional table away from the conventional sofa to ensure that the person entering or leaving could get their legs and feet safely past such a corner leg. If, however, those corner legs on the side of the conventional table closest to both users were moved inwards, so as to always remain on the inner side of a user's body, then the table does not have to be moved far from the conventional sofa to allow entry or exit—there is no corner leg to interfere with that process. Additionally, this configuration means that there are no corner legs adjacent to a user to bang into and injure the user on such entry or exit, and it precludes the even greater risk of tripping on such a leg and falling, with possible consequent serious injury. The requirements for performing a variety of activities using a conventional chair and table, or desk, are well understood. However, to perform those same activities from a relatively immoveable conventional sofa requires substantial redesign to the table being used with that sofa, especially with regard to safe and easy access, then exit, from the table both before and after use.

As a result, many have proposed devices which allow one to more easily work or eat at the couch. Such devices generally take the form of lap desks and other devices which are based on the assumption that the coffee table or any table is too unsuitable to even be adapted to carry out the desired tasks.

While these devices may be suitable for the particular purpose employed, or for general use, such devices can always be improved.

Accordingly, there is a need for a table suitable for use in front of a couch or chair that allows a variety of activities to be carried out which could not be carried out effectively with a conventional coffee table. There is an additional need for a table that allows a person to eat, work, and read at the table while comfortably seated in the couch or chair, providing a convenient surface immediately adjacent to the lap of the user. There is a further need for a table which reduces the occurrence of ankle injuries such as those that occur when a user inadvertently hits their ankle against a table leg when moving to sit down or stand up. There is an additional need for a table that reduces the chance a user trips on a corner table leg and falls, incurring possible serious injury. There is a need for a table that provides ease of entry, before the surface of the table is even used, and ease of exit from the table afterwards. There is also a need for a table which is useable from opposite sides and which allows a number of people to work, eat, or read at the same time. There is another need for a table that provides for the addition of seating/non-seating areas to a side of the table. The present invention fulfills these needs and provides other related advantages.

SUMMARY OF THE INVENTION

The present invention is directed to a table suitable for use in front of a couch or chair that allows a variety of activities to be carried out which could not be carried out effectively with a conventional coffee table. People can eat, work, and read at a table embodying the present invention that provides a convenient surface immediately adjacent to the lap of that person while they are comfortably seated in their couch or chair. The table described below reduces the occurrence of ankle injuries caused by a person inadvertently hitting their ankle against a table leg when moving to sit down or stand up due to the positioning of the table legs, among other things. The table reduces the chances a user will trip on a corner table leg and fall, incurring possible serious injury. The table provides ease of entry and ease of exit. For example, when a conventional table is used simultaneously by two people seated on the same sofa, the simple arrival or departure of one person, requiring that the conventional table be moved away from the sofa, causes inconvenience and possible hazard to the other person, especially when conventional corner legs make the required move of the conventional table away from the sofa substantial enough to enable their feet and legs to pass freely and safely. When no corner legs are present, as on one side of the table embodying the present invention, then the move required is minimal to ensure safe entry or exit, and the other user is not unduly inconvenienced—an important safety consideration when the user may be engaged in eating a plate of hot food or enjoying a hot drink that could spill.

The leg configuration makes the table of the present invention not only easy to use, but also easy and safe in the way table provides for entry and exit. The table is useable from opposite sides and allows a number of people to work, eat, or read at the same time. Features of the table provide for additional seating/non-seating areas that can be added to a side of the table.

The present invention resides in a table that includes first and second table sides where each table side has a vertical plane. The table also includes upper and lower horizontal levels. There are at least two seating areas on the first table side, wherein a first edge of the lower level at each seating area is substantially recessed from the first table side vertical plane, and at least two non-seating areas on the second table side, wherein a second edge of the lower level at each non-seating area extends substantially to the second table side vertical plane. The lower level is movable to add a seating area to one of the first and second table sides and add a non-seating area to the other of the first and second table sides.

The table includes at least two adjacent sections, wherein each section has one seating area at one of the first and second table sides, and has one non-seating area at the other of the first and second table sides. Each section is bordered by a table leg, wherein adjacent sections share a table leg.

The table includes three sections, wherein the first table side includes at least two seating areas on non-adjacent sections and the second table side includes at least two non-seating areas on non-adjacent sections. The section disposed between the non-adjacent sections includes one of seating area and non-seating areas on the first table side and the other of the seating and non-seating areas on the second table side.

The upper level of the table comprises a single continuous area.

At each seating area of the table, an edge of the upper level extends substantially to at least one of the first and second side vertical planes. At each non-seating area of the table, an edge of the upper level extends substantially to at least one of the front and the rear vertical planes.

The lower level of the table includes a first section, a second section and a middle section. The middle section, disposed between the first and second sections, is movable between the first and second table side vertical planes to add a seating area to the table side the edge of the lower level is substantially recessed from.

The table includes two table legs on the second table side and a minimum of one table leg on the first table side, whereby users at the seating areas can sit with their legs extending beneath the upper level while the table leg on the first table side does not interfere with the legs of the user. The location of the table legs renders the table wheel-chair accessible from the second table side. The second side table legs are disposed on opposite ends of the table and the first side table leg is disposed between the opposite ends of the table. The table legs comprise wheel-mounted legs.

The upper level of the table includes a plurality of transparent panes providing views of the lower level.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
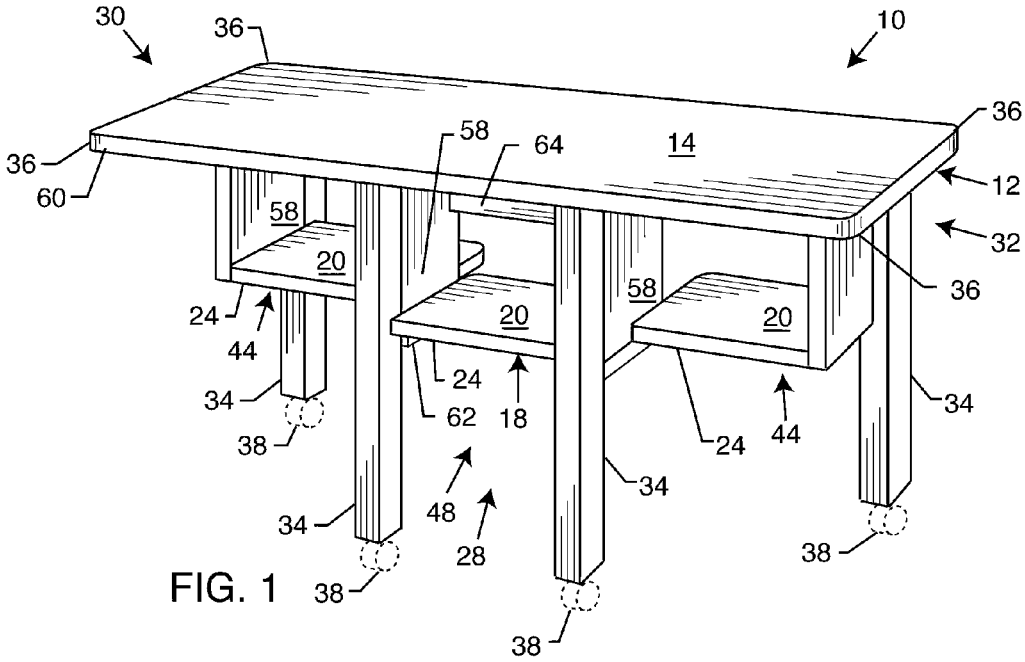
FIG. 1 is a front perspective view of a table embodying the present invention.
Figure 2:
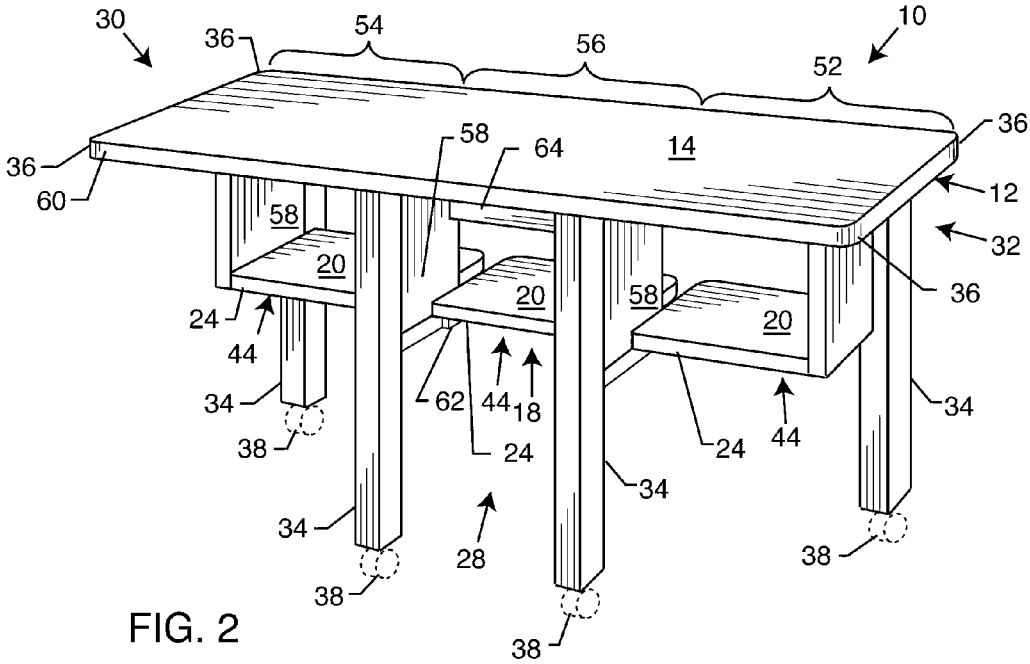
FIG. 2 is a front perspective view of the table of FIG. 1 with a middle lower level moved closer to a rear side of the table.
Figure 3:
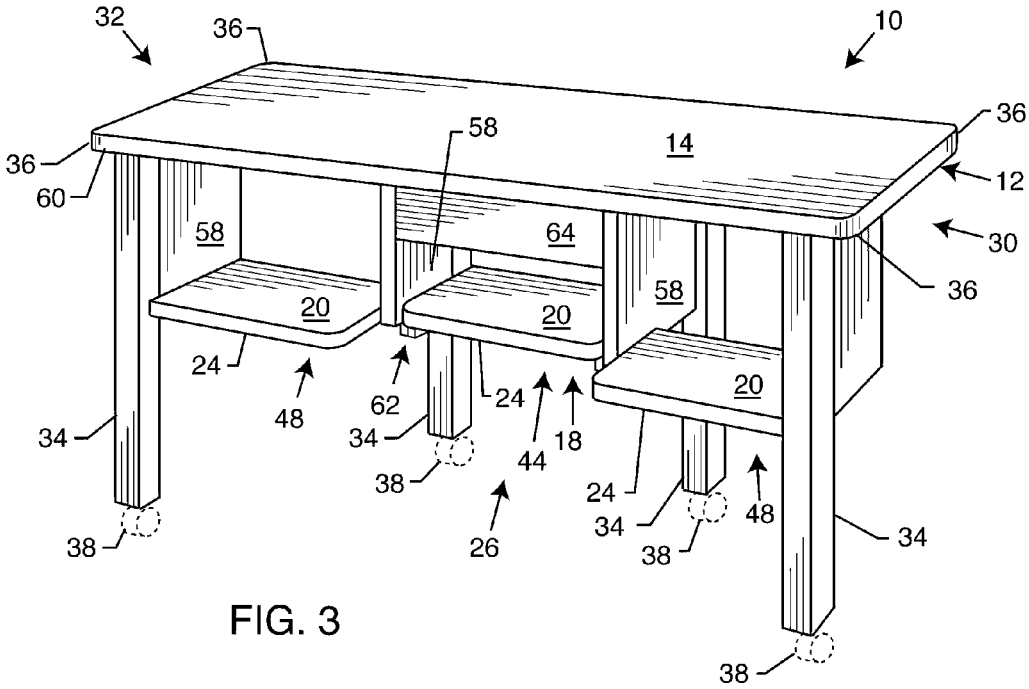
FIG. 3 is a rear perspective view of a table embodying the present invention.
Figure 4:
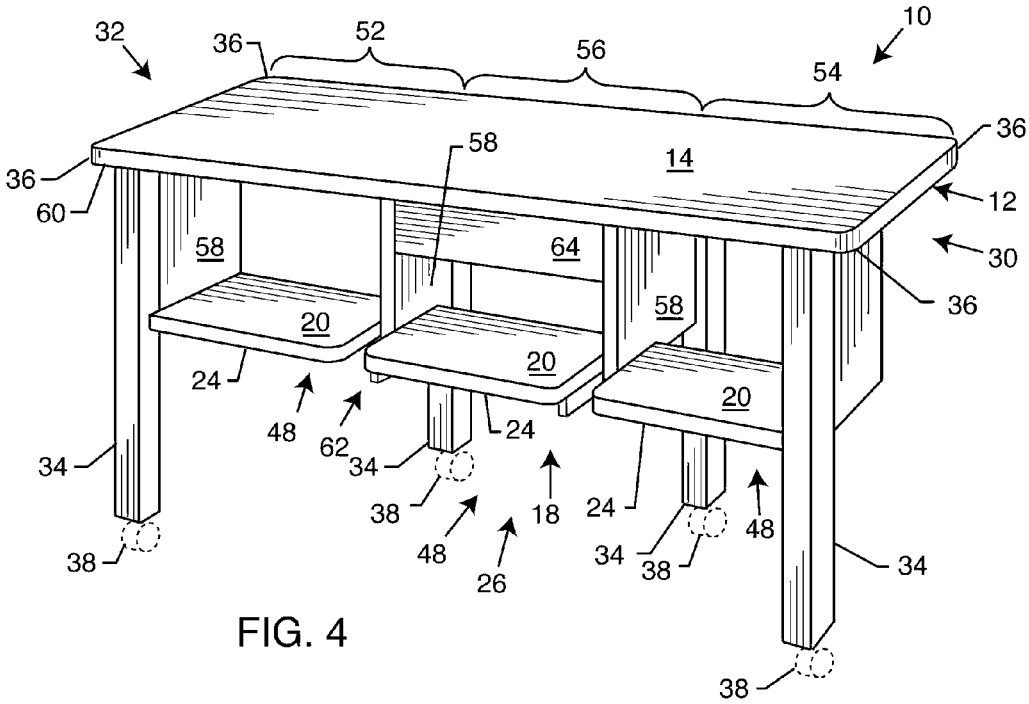
FIG. 4 is a rear perspective view of the table of FIG. 1 with a middle lower level moved closer to a rear side of the table.
Figure 5:
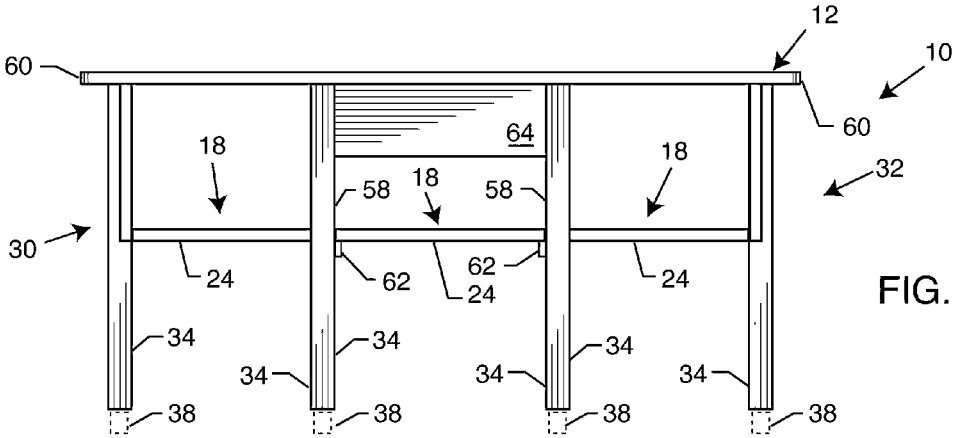
FIG. 5 is a front side elevation view of the table of FIG. 1.
Figure 6:
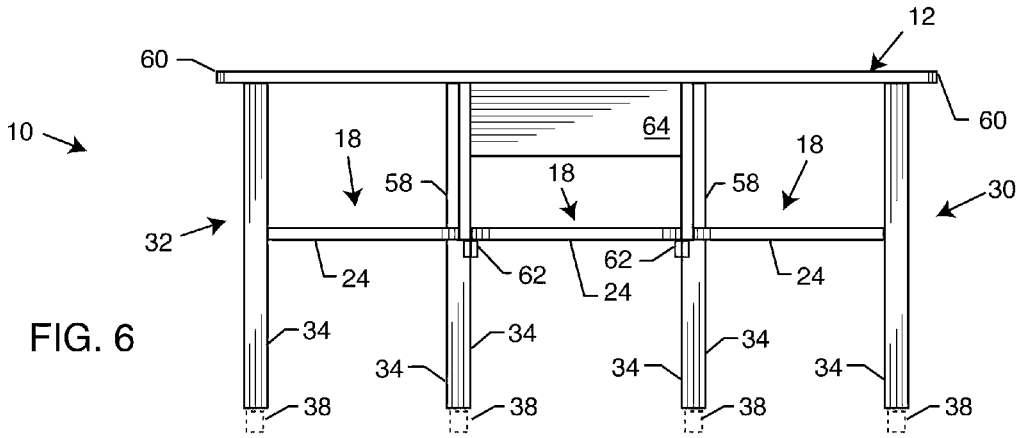
FIG. 6 is a rear side elevation view of the table of FIG. 3.
Figure 7:
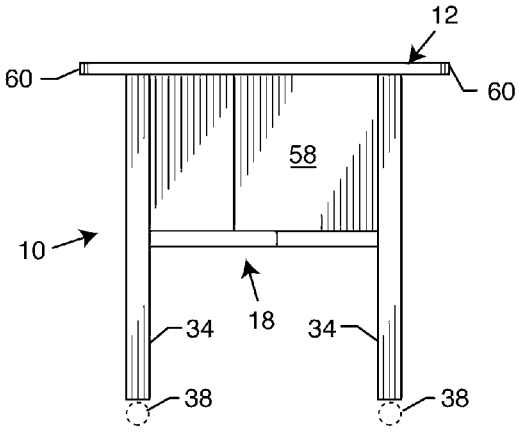
FIG. 7 is a left side elevation view of the table of FIG. 2.
Figure 8:
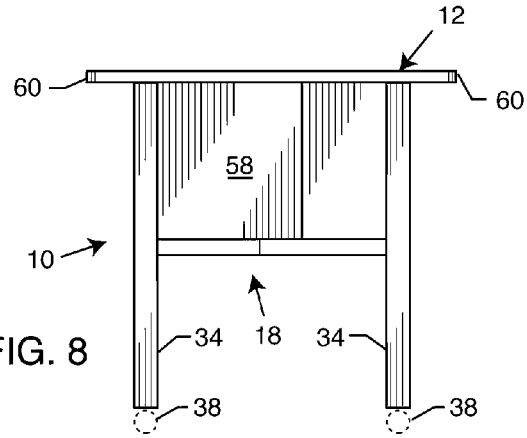
FIG. 8 is a right side elevation view of the table of FIG. 2.
Figure 9:
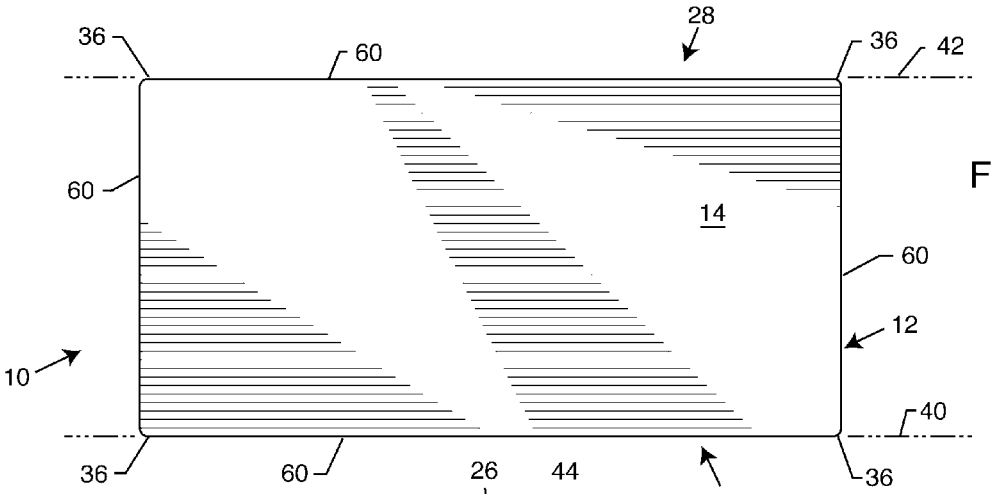
FIG. 9 is a top plan view of the table of FIG. 1.
Figure 10:
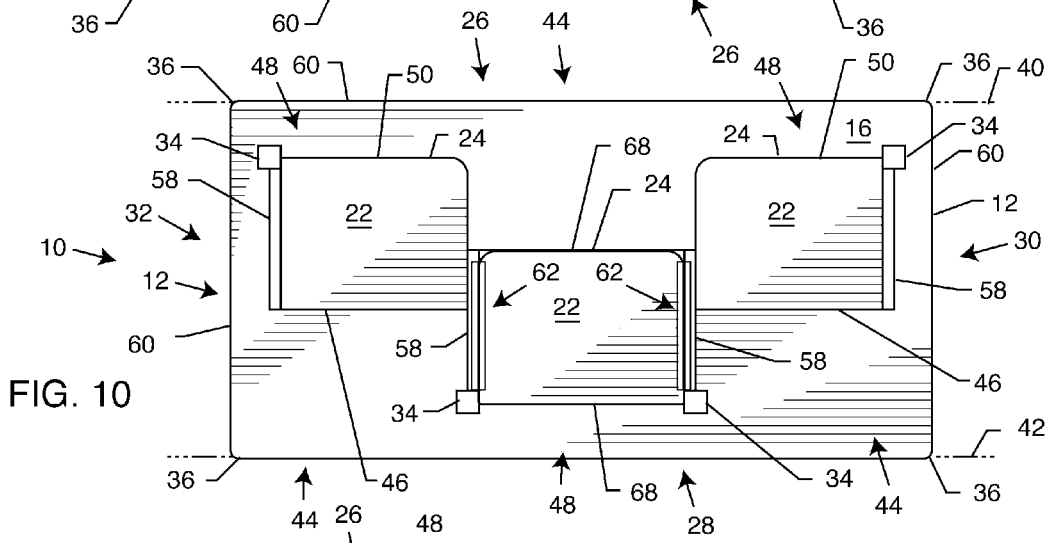
FIG. 10 is a bottom plan view of the table of FIG. 1.
Figure 11:
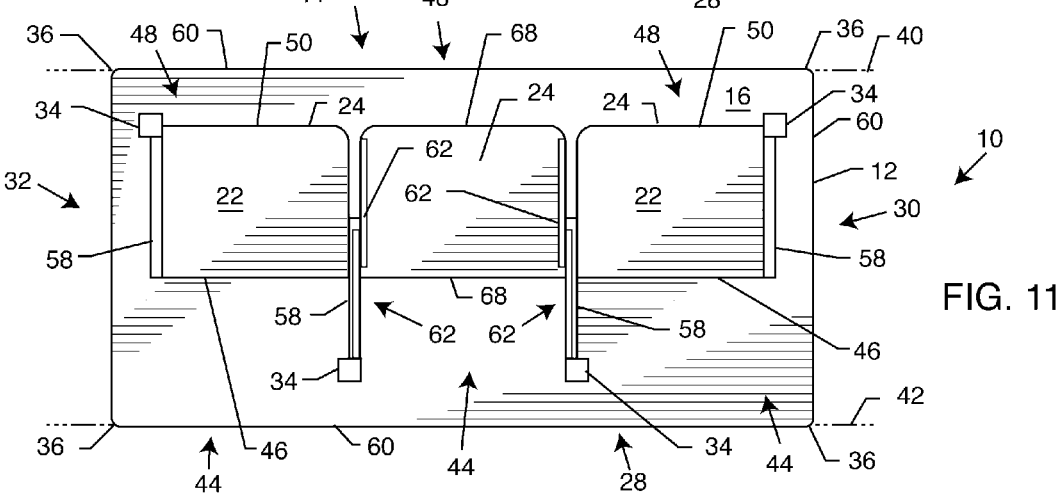
FIG. 11 is a bottom plan view of the table of FIG. 2.
Figure 12:
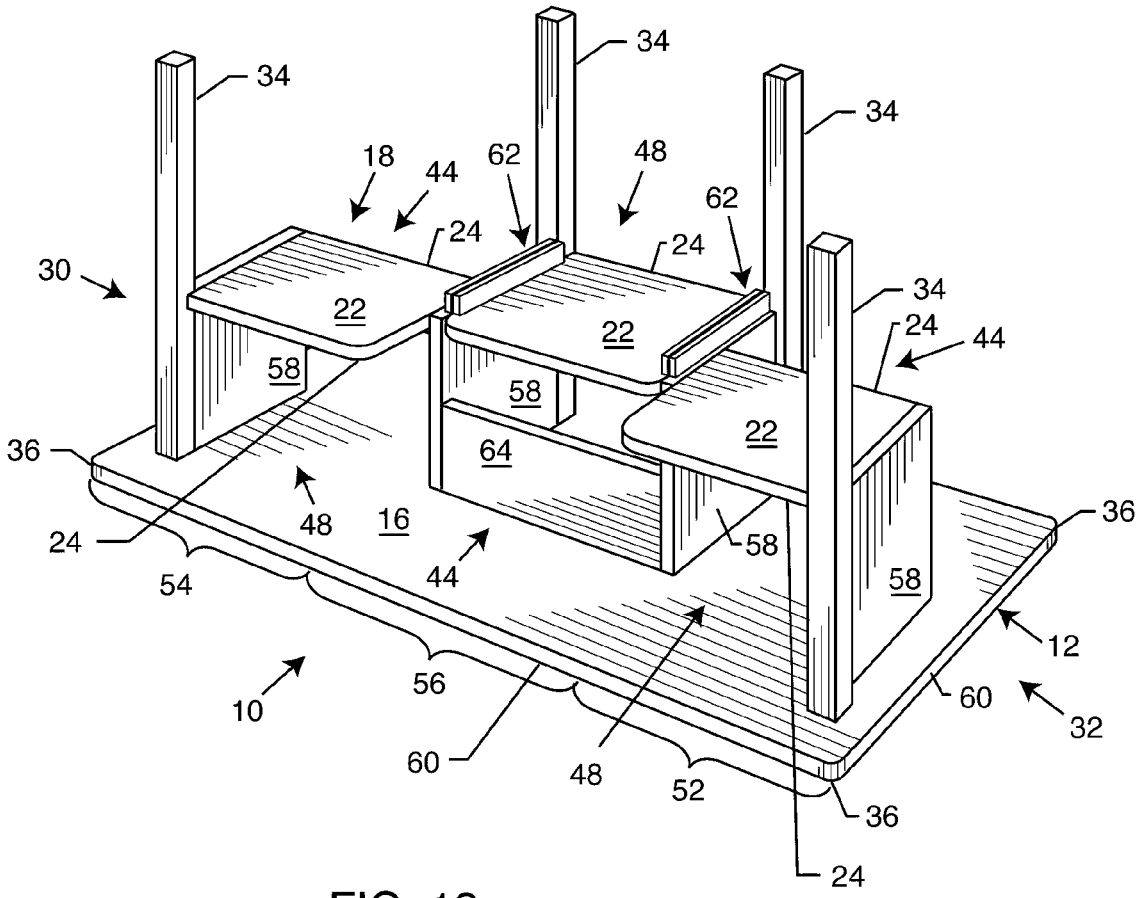
FIG. 12 is an upside down perspective view of the table of FIG. 3.
Figure 13:
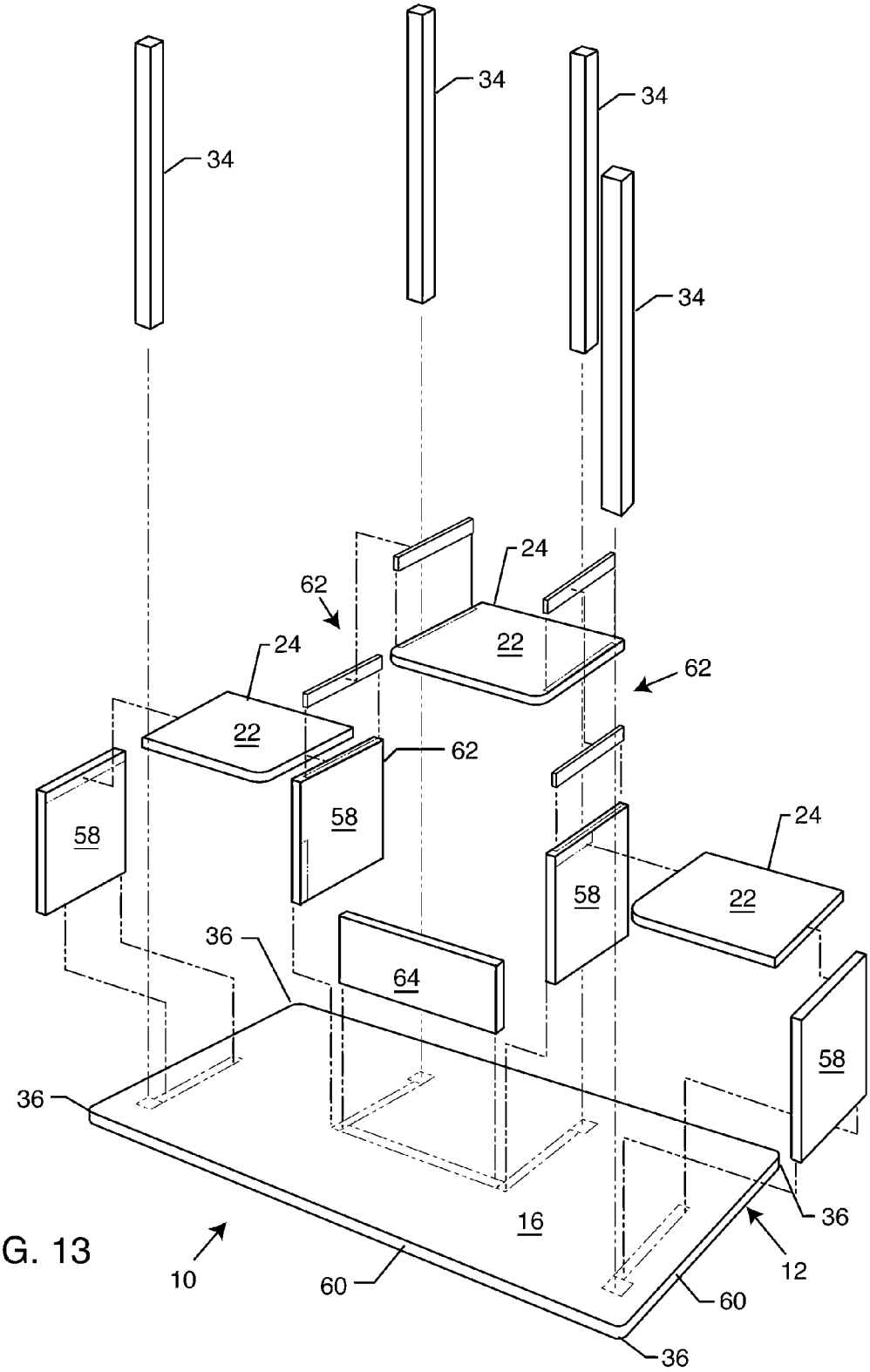
FIG. 13 is an exploded upside down perspective view of the table of FIG. 3.

The present invention is directed to a table which is configured so as to be useful for a variety of purposes.

In accordance with one embodiment of the present invention, a table 10, as illustrated in FIGS. 1-13 include an upper horizontal level 12 having generally planar upper and lower surfaces 14, 16. The upper level 12 is a continuous level of single piece construction that is rectangular in shape. The table 10 also includes a lower horizontal level 18 having generally planar upper and lower surface 20, 22. The lower level 18 is defined by several individual shelves or platform segments 24, preferably three platform segments 24, generally aligned along the same horizontal plane. In the alternative, the lower level 18 may be a continuous level of single piece construction that is rectangular in shape or in the shape of a number of staggered, connected areas. In another alternative, the upper level 12 may be in the shape of a number of staggered areas of single piece construction or the upper level 12 may be defined by several individual platform segments, similar to the segments 24 of the lower level 18.

The table 10 includes a rear side 26, a front side 28, a right side 30 and a left side 32. The rear and front sides 26, 28 are interchangeable but are designated "front" and "rear" herein for the purpose of establishing a convention for the following discussion. The table 10 also includes a number of table legs 34, preferably four legs 34, which connect the upper and lower levels 12, 18. The table legs 34 are located within a perimeter defined by the upper level 12. The legs 34 along the rear side 26 of the table 10 are positioned slightly inwards from the perimeter of the upper level 12, along both the length and width of the table 10, but still relatively near corners 36 of the upper level 12 along the rear side 26. Each of the legs 34 along the front side 28 of the table are positioned inwards from a respective corner 36 on the right or left sides 30, 32 of the upper level 12 by a distance of one third the length of the upper level 12 of the table 10 with the rear side legs 34 positioned slightly inwards from the perimeter of the upper level 12 along the width of the table 10. The positioning of the legs 34 around the table 10 is a safety feature that allows people to enter and exit the table 10 without having to worry about snagging their feet on a table leg 34 and falling, especially vulnerable older users. In the alternative, the legs 34 may be generally aligned with and positioned along the perimeter defined by the upper level 12. A user sitting at the table 10 can sit with their legs extending beneath the upper level 12 without the table legs 34 on the rear side 26 of the table 10 contacting or otherwise interfering with their legs. For a user seated at one of the two permanent seating positions on the front side 28, the absence of an outer leg 34 (both legs 34 having been moved towards the center of the table 10) means that the user is not hemmed into a narrow space between the center shelf of the lower level 18 and an outer leg that may have been positioned as the legs 34 are on the rear side 26. In the absence of such an outer leg, the user, while still facing towards an adequate and useable segment of the surface of the upper level 12, can nevertheless spread their knees and legs outwards to achieve maximum comfort. The location of the table legs 34 in this manner also renders the table 10 wheel-chair accessible on at least the rear side 26 of the table 10. Each of the table legs 34 is wheel-mounted, with wheels 38, preferably castors or the like, so that the table 10 can be positioned close to a sofa, chair, recliner or the like, used for eating, reading, writing or other activities the like, and then pushed away for use as a coffee table. With the table 10 being wheel-mounted, a user can rotate the table 10 to use the table 10 from the opposite side without having to move their seat. The wheels 38 allow the table 10 to be rotated three hundred sixty degrees as well as allowing the table 10 to be moved from room to room.

The rear and front sides 26, 28 of the table 10 each generally define a respective vertical plane 40, 42. However, it is important to note that none of the platform segments 24 extend fully between the rear and front sides 26, 28. Preferably, each platform segment 24 extends approximately one half of the distance between the rear and front sides 26, 28, and each is biased against either the rear side 26 or the front side 28. Accordingly, the concept of the "sides" is conceptual only, as the sides are a discontinuous combination of the upper level 12 and platform segments 24 of the lower level 18.

The table 10 has seating areas 44 where a person could sit with a tabletop surface immediately in front of him at a comfortable height for working, eating, reading, or the like, and space below the tabletop surface for his legs to extend comfortably. There are at least two seating areas 44 on the front table side 28, positioned on opposite sides 30, 32 of the table 10. At each seating area 44 on the front table side 28, a seating area edge 46 of the platform segment 24 of the lower level 18 is substantially recessed from the vertical plane 42 on the front side 28 of the table 10. For example, two people can be seated at the front side 28 of the table 10 where the upper level 12 of the table 10 extends immediately adjacent to the front vertical plane 42 but the platform segment 24 of the lower level 18 is recessed from the vertical plane 42. There are also at least two non-seating areas 48 on the rear table side 26. The non-seating areas 48 on the rear side 26 are equal in number to the seating areas 44 and are in opposite positions therefrom. At each non-seating area 48 on the rear side 26, a non-seating area edge 50 of the platform segment 24 of the lower level 18, opposite the edge 46, extends substantially to the vertical plane 40 of the rear side 26 of the table 10. At each seating and non-seating area 44, 48 of the table 10, a perimeter edge 60 of the upper level 12 extends substantially to both of the vertical planes 40, 42. A single person can be seated on either side 26, 28 of the table 10 where the upper level 12 of the table 10 extends immediately adjacent to the vertical plane 40, 42 but the platform segment 24 of the lower level 18 is recessed from the vertical plane 40, 42.

The table 10 has three longitudinal sections, including a first section 52, a second section 54, and a middle section 56. The first section 52 and middle section 56 are adjacent sections. Also, the second sections 54 and middle section 56 are adjacent sections. Adjacent sections 52, 54, 56 are joined by table legs 34 and vertical panel segments 58, which also provide support for the various platform segments 24. The table 10 shown includes at least two adjacent sections 52, 54, 56, each section 52, 54, 56 having one seating area at one of the rear and front sides 26, 28, and one non-seating area at the other of the rear and front sides 26, 28. Each section 52, 54, 56 is bordered by a table leg 34 and adjacent sections 52, 54, 56 share a table leg 34. In the table 10 with three sections 52, 54, 56, the front side 28 of the table 10 includes at least two seating areas 44 on non-adjacent sections 52, 54 and the rear side 26 of the table 10 includes at least two non-seating areas 48 on non-adjacent sections 52, 54. The middle section 56, disposed between the non-adjacent sections 52, 54, has a seating area 44 on one of the rear and front sides 26, 28 and a non-seating area 48 on the other of the rear and front sides 26, 28.

The platform segment 24 of the lower level 18 of the middle section 56, disposed between the first and second sections 52, 54, is slidably movable between the rear and front vertical planes 40, 42 to add a seating area 44 to the table side 26, 28 the edge of the platform segment 24 of the middle section lower level 18 is substantially recessed from and a non-seating area 48 to the opposite table side 28, 26. Therefore, a user can add/subtract seating/non-seating areas 44, 48 to/from the rear or front side 26, 28. For example, a user adds a seating area 44 to the front side 28 by sliding the platform segment 24 of the middle section 56 to wards the rear side 26. This movement of the platform segment 24 of the middle section 56 also then adds a non-seating area 48 to the rear side 26 of the table 10. In this configuration, the front side 28 of the table 10 would have three seating areas 44 and the rear side 26 of the table 10 would have three non-seating areas 48. The platform segment 24 of the middle section 56 is movable by connecting the platform segment 24 to the table legs 34 and vertical segments 58 of the middle section 56 by a conventional sliding mechanism 62 that includes, without limitation, sliders, tracks, rollers or the like. The movable platform segment 24 of the middle section 56 allows three people to sit side by side on the same side 28 of the table 10. That means that the front side 28 of the table 10 can be used by up to three people, but that the rear side 26 of the table 10 can only be used by at most one person seated in the middle section 56, with the outer platform segments 24 of the lower level 18 of the adjacent sections 52, 54 to either side of him/her (the front side 28 seating only two persons in this configuration). Therefore, the edges 68 of the middle section platform segment 24 facing the rear and front sides 26, 28 of the table 10 can not be described as either seating area and non-seating area edges 46, 50 as can be done with the fixed platform segments 24 of sections 52, 54 as edge 68 is a seating area edge or non-seating area edge depending on which side 26, 28, the edge 68 is closest to.

A central vertical panel segment 64, which provides lateral support to the table 10, extends downward from three to four inches from the lower surface 16 of the upper level 12. The central vertical panel segment 64, like the other vertical panel segments 58, is made from various materials including, without limitation, glass, plastic or wood. The height of the central vertical panel segment 64 allows for objects, like remote controls that are stored on that middle panel segment 24, to be left in place, and to pass under the vertical panel segment 64 when the middle panel segment 24 is moved backwards, on its sliding mechanism 62, into its rearward position in line with the two outer panel segments 24. The exposed corners of the panel segments 24 should be slightly rounded. The corners 36 of the upper level 12 should also be slightly rounded.

Figure 14:
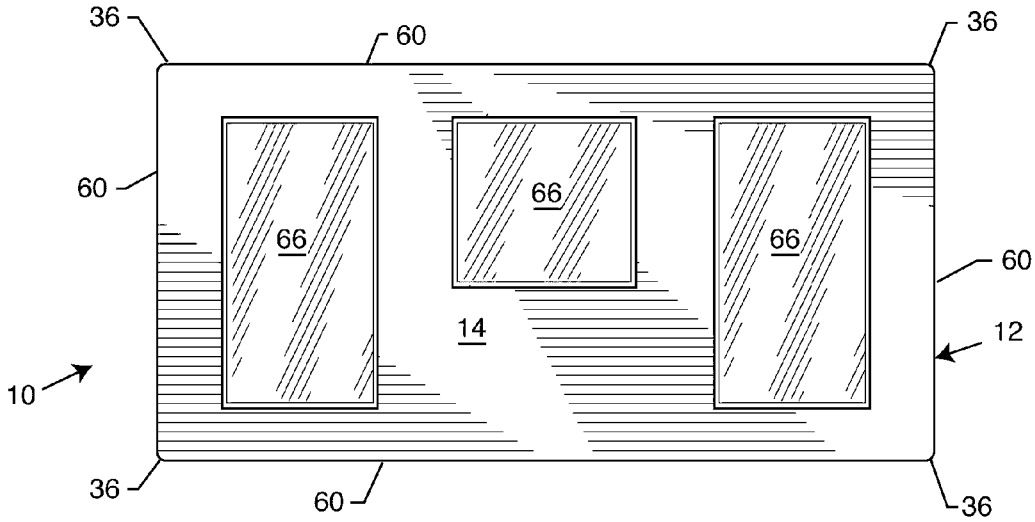
FIG. 14 is a top plan view of another table embodying the present invention.
Figure 15:
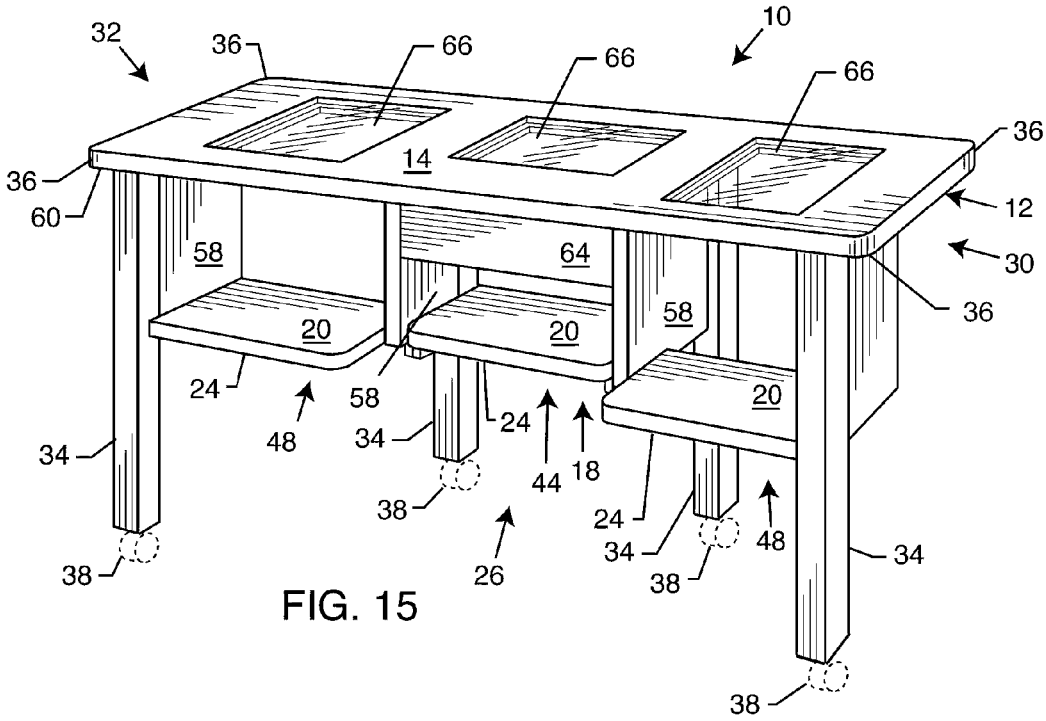
FIG. 15 is a rear perspective view of the table of FIG. 14.

As seen in FIGS. 14 and 15, another embodiment of the table 10 includes a plurality of transparent panes 66 (glass, plastic or the like) that are set into the upper level 12 of the table 10 in each section 52, 54, 56 in order to provide views of objects (remote controls, magazines, electronic devices, bric-a-brac or the like) resting on the platform segments 24 of the lower level 18. The panes 66 above each section 52, 54, 56 may be the same or different sizes as well as being the same or different shapes (e.g., rectangular, oval, circular or any desired symmetrical or non-symmetrical shape).

It should be understood that the number of seating and non-seating areas shown is merely illustrative and that a longer table can accommodate a greater number of sections of seating/non-seating areas.

The components of the table 10 can be connected during construction using conventional methods that include, without limitation, hole and peg construction, glue, nails, screws or other sturdy attachment means. A table 10 having two, four, five, or more portions or sections can also be created with equal ease.

It should be understood that the instant discussion focuses on the functional configuration of the table 10, and not particular details of the table's construction. Thus, structural considerations such as brackets and cross supports are omitted for clarity. In addition, cosmetic design features are simplified or are varied from more aesthetic designs for the purposes of understanding the utilitarian features of the present invention.

Although embodiments of the present invention have been described in detail for purposes of illustration, various modifications may be made without departing from the scope and spirit of the invention.

What is claimed is:

1. A table, comprising:

a first table side having a vertical plane;

a second table side having a vertical plane;

an upper horizontal level;

a lower horizontal level;

at least two seating areas on the first table side, wherein a first edge of the lower level at each seating area is substantially recessed from the first table side vertical plane;

at least two non-seating areas on the second table side, wherein a second edge of the lower level at each non-seating area extends substantially to the second table side vertical plane; and a sliding mechanism associated with the lower horizontal level to add a seating area to one of the first and second table sides and add a non-seating area to the other of the first and second table sides without adjusting the upper horizontal level.

2. The table of claim 1, including at least two adjacent sections, wherein each section has one seating area at one of the first and second table sides, and has one non-seating area at the other of the first and second table sides.

3. The table of claim 2, wherein each section is bordered by a table leg, wherein adjacent sections share a table leg.

4. The table of claim 1, wherein the upper level comprises a single continuous area.

5. The table of claim 1, wherein at each seating area, an edge of the upper level extends substantially to at least one of the first and second side vertical planes.

6. The table of claim 1, wherein at each non-seating area, an edge of the upper level extends substantially to at least one of the first and second side vertical planes.

7. The table of claim 1, wherein the lower level includes a first section, a second section and a middle section.

8. The table of claim 7, wherein the middle section, disposed between the first and second sections, is movable between the first and second table side vertical planes to add a seating area to the table side the edge of the lower level is substantially recessed from.

9. The table of claim 1, including two table legs on the second table side and a table leg on the first table side, whereby a user at the seating areas can sit with their legs extending beneath the upper level while the table leg on the first table side does not interfere with the legs of the user.

10. The table of claim 9, wherein the location of the table legs renders the table wheel-chair accessible from the first and second table sides.

11. The table of claim 9, wherein the second side table legs are disposed on opposite ends of the table and the first side table leg is disposed between the opposite ends of the table.

12. The table of claim 9, wherein the table legs comprise wheel-mounted legs.

13. The table of claim 1, wherein the upper level includes a plurality of transparent panes providing views of the lower level.

14. The table of claim 1, wherein the two seating areas are non-adjacent on the first table side and the two non-seating areas are non-adjacent on the second table side.

15. The table of claim 14, including one of a seating area or a non-seating area on the first table side between the non-adjacent seating areas and the other of the seating area or the non-seating area on the second table side between the non-adjacent non-seating areas.

16. A table, comprising:

a first table side having a vertical plane;

a second table side having a vertical plane;

an upper horizontal level;

a lower horizontal level;

a first section;

a second section;

a middle section disposed between the first and second sections;

at least two seating areas on the first table side, wherein a first edge of the lower level at each seating area is substantially recessed from the first table side vertical plane;

at least two non-seating areas on the second table side, wherein a second edge of the lower level at each non-seating area extends substantially to the second table side vertical plane; and a sliding mechanism associated with the lower horizontal level to position the middle section between the first and second table side vertical planes to add a seating area to one of the first and second table sides and add a non-seating area to the other of the first and second tables sides without adjusting the upper horizontal level, and wherein the first table side includes at least two seating areas on non-adjacent sections and the second table side includes at least two non-seating areas on non-adjacent sections.

17. The table of claim 16, wherein at least two of the sections are adjacent, wherein each section has one seating area at one of the first and second table sides, one non-seating area at the other of the first and second table sides, and is bordered by a table leg, adjacent sections sharing a table leg.

18. The table of claim 16, including two table legs on the second table side and a table leg on the first table side, whereby a user at the seating areas can sit with their legs extending beneath the upper level while the table leg on the first table side does not interfere with the legs of the user, and wherein the second side table legs are disposed on opposite ends of the table and the first side table leg is disposed between the opposite ends of the table.

19. The table of claim 16, wherein at each seating and non-seating area, an edge of the upper level extends substantially to at least one of the first and second side vertical planes.

20. A table, comprising:

a first table side having a vertical plane;

a second table side having a vertical plane;

an upper horizontal level;

a lower horizontal level;

two table legs on the second table side and a table leg on the first table side;

a first section;

a second section;

a middle section disposed between the first and second sections, at least two of the sections being adjacent;

at least two seating areas on the first table side, wherein a first edge of the lower level at each seating area is substantially recessed from the first table side vertical plane;

at least two non-seating areas on the second table side, wherein a second edge of the lower level at each non-seating area extends substantially to the second table side vertical plane; and a sliding mechanism associated with the lower horizontal level to position the middle section between the first and second table side vertical planes to add a seating area to one of the first and second table sides and add a non-seating area to the other of the first and second table sides without adjusting the upper horizontal level, the first table side includes at least two seating areas on non-adjacent sections, the second table side includes at least two non-seating areas on non-adjacent sections, and each section has one seating area at one of the first and second table sides and one non-seating area at the other of the first and second table sides.

* * * * *